US011723497B1

(12) United States Patent
Lane

(10) Patent No.: US 11,723,497 B1
(45) Date of Patent: Aug. 15, 2023

(54) TOILET SEAT LIFTING SYSTEM

(71) Applicant: Thomas Lane, Tampa, FL (US)

(72) Inventor: Thomas Lane, Tampa, FL (US)

( * ) Notice: Subject to any disclaimer, the term of this patent is extended or adjusted under 35 U.S.C. 154(b) by 0 days.

(21) Appl. No.: 17/585,710

(22) Filed: Jan. 27, 2022

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.2, 246.1–246.5
See application file for complete search history.

(56) References Cited

U.S. PATENT DOCUMENTS 2,842,779 A * 7/1958 Zulkoski ..... F15B 7/08 4/246.2
4,103,371 A * 8/1978 Wilson ..... A47K 13/10 49/265
4,951,325 A * 8/1990 Tack ..... A47K 13/10 16/84
5,029,347 A * 7/1991 Lin ..... A47K 13/10 220/264
5,978,974 A 11/1999 Mullen
6,601,241 B1 8/2003 Skotzke
6,978,491 B1 * 12/2005 Miller ..... E03D 11/025 4/300.3
2006/0242755 A1 * 11/2006 Lohss ..... A47K 13/10 4/246.1
2017/0239697 A1 * 8/2017 Oakner ..... B08B 9/035

* cited by examiner

*Primary Examiner* — Christine J Skubinna
(74) *Attorney, Agent, or Firm* — Sanchelima & Associates, P.A.; Christian Sanchelima; Jesus Sanchelima

(57) ABSTRACT

A toilet seat lifting system includes a foot-operated bellows connected to a hinged rod which is surrounded by a sleeve. The rod is then extended by the air produced by the bellows and the rod is attached to the toilet seat with adhesive or suction cup. The rod includes a hollow outer rod and an inner rod that is inserted within the outer rod. The outer rod is then sealed against the inner rod through an air tight seal. When the bellows is actuated, air is supplied through the bottom rod and released within the outer rod. Since the outer rod is air tight, the pressure created by the air within the rod forces a latch at the top of the outer rod to open and release the pressure. The opening of the latch in turn actuates the lifting of the toilet seat.

1 Claim, 3 Drawing Sheets

TOILET SEAT LIFTING SYSTEM

BACKGROUND OF THE INVENTION

1. Field of the Invention

The present invention relates to a lifter for a toilet seat and, more particularly, to a foot pedal toilet seat lifter system that includes a foot operated bellows that actuates a latch to lift a toilet seat.

2. Description of the Related Art

Several designs for a toilet seat lifter have been designed in the past. None of them, however, include a toilet seat lifting system including a foot-operated bellows connected to a hinged rod which is surrounded by a sleeve. The rod is then extended by the air produced by the bellows and the rod is attached to the toilet seat with adhesive or suction cup. The rod includes a hollow outer rod and an inner rod that is inserted within the outer rod. The outer rod is then sealed against the inner rod through an air tight seal. When the bellows is actuated, air is supplied through the bottom rod and released within the outer rod. Since the outer rod is air tight, the pressure created by the air within the rod forces a latch at the top of the outer rod to open and release the pressure. The opening of the latch in turn actuates the lifting of the toilet seat. It is known that individuals often avoid touching public toilets due to the transmittal of germs that may occur when coining into contact with the toiletry. Additionally, the fear of transmittal of Covid-19 is also a factor in avoiding contact with public toilets. Therefore, there is a need for a foot pedal toilet seat lifting system that prevents a user from coining into direct contact with a toilet seat. The system will automatically lift the toilet seat for the user and prevent the need for the user to use their hands to lift the toilet seat. Further the system operates mechanically and has no need for external power supplies.

Applicant believes that a related reference corresponds to U.S. Pat. No. 6,601,241 issued for a toilet seat lifting device that is actuated by a foot pedal. Applicant believes that another related reference corresponds to U.S. Pat. No. 5,978,974 issued for an apparatus for raising and lowering a toilet seat that uses a foot pedal and an air cylinder. However, the cited references differ from the present invention because they fail to disclose a toilet lifting system comprising a foot operated bellows that is connected to a hinged rod surrounded by a sleeve. The references further fail to disclose the inner and outer rod of the present invention which receives the air from the bellows. The air presser created within the rod actuates a latch to lift a toilet seat without the need of coining into contact with a user.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a toilet seat lifting system which prevents the need for a user to come into direct contact with a toilet seat thereby reducing the contamination of germs.

It is another object of this invention to provide a toilet seat lifting system which does not require an external electrical power source making the system universal and installable to any toilet.

It is still another object of the present invention to provide a toilet seat lifting system which includes a foot operated bellows which receives pressure from a user's foot to create an easy actuating means for a toilet seat.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
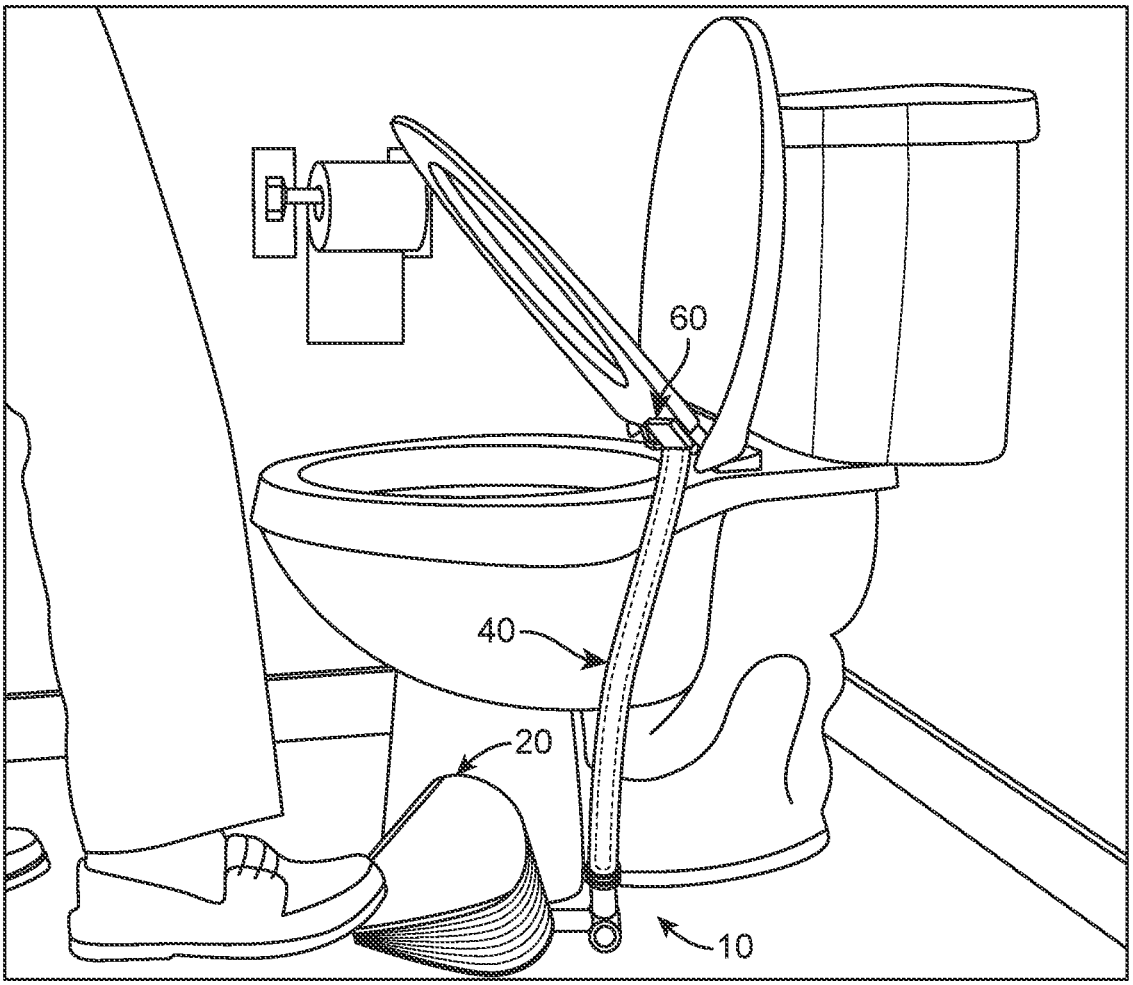
FIG. 1 represents an isometric operational view of toilet seat lifting system 10 in accordance to an embodiment of the present invention.

Referring now to the drawings, where the present invention is generally referred to with numeral 10, it can be observed a toilet seat lifting system 10 which basically includes a bellows assembly 20, a rod assembly 60, and a latch assembly 80.

Figure 2:
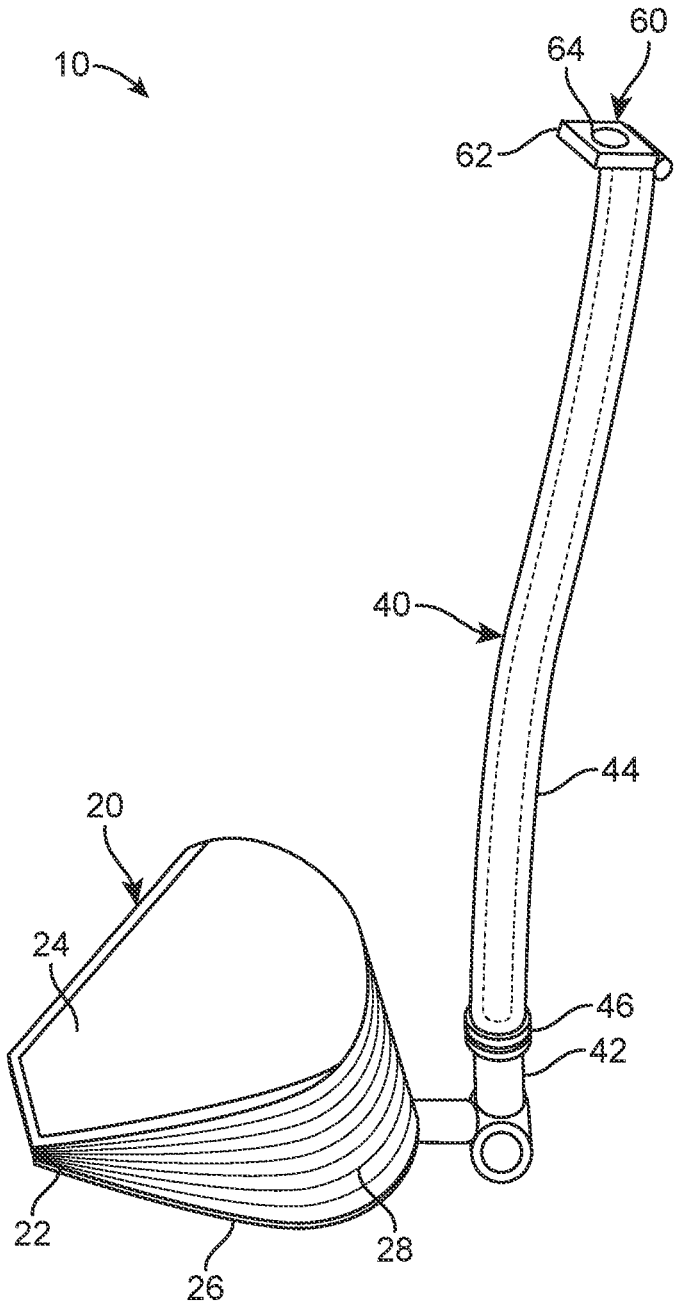
FIG. 2 shows an isometric view of toilet seat lifting system 10 in accordance to an embodiment of the present invention.

Bellows assembly 20 includes a bellows 22 which is adapted to be operated by a user's foot. In the present embodiment, the bellows 22 is placed on a ground surface next to a toiletry which may be located in a public place such as a restaurant, a business, or other locations. In one embodiment, as seen in FIG. 2 of the provided drawings, bellows 22 includes a first plate 24 being a top plate and a second plate 26 being a bottom plate which is placed on the ground surface. First plate 24 is made of a durable material to withstand repeated force from a user's foot. In one embodiment, first plate 24 may be made of a wood, plastic, or metal material. Second plate 26 is then formed of the same material being identical to first plate 24. In one implementation, second plate 26 may be secured to the ground surface through a securing means. The securing means may be provided as an adhesive or a press lock button that receives the second plate 26 on the ground surface.

Figure 3:
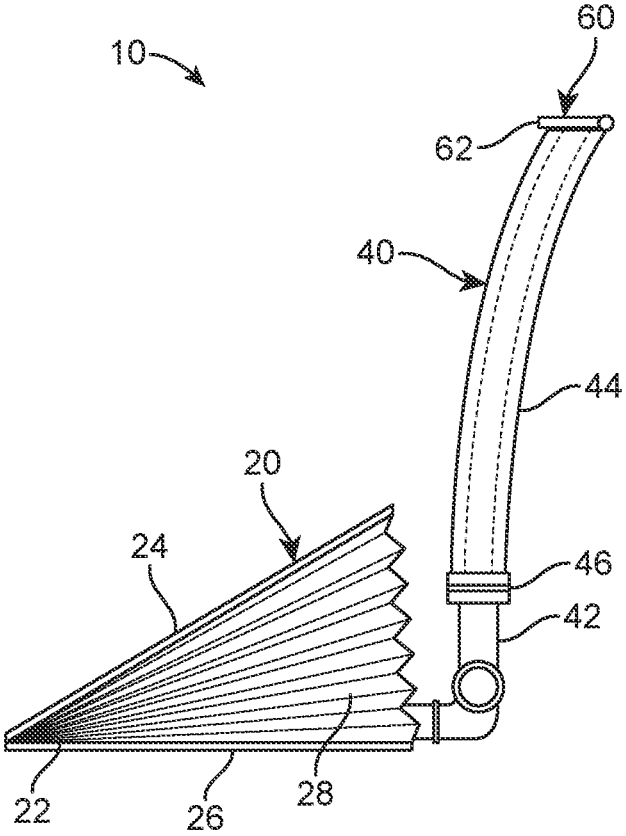
FIG. 3 illustrates a side view of toilet seat lifting system 10 depicting a bellow assembly 20, a rod assembly 40, and a latch assembly 60, in accordance to an embodiment of the present invention.
Figure 4:
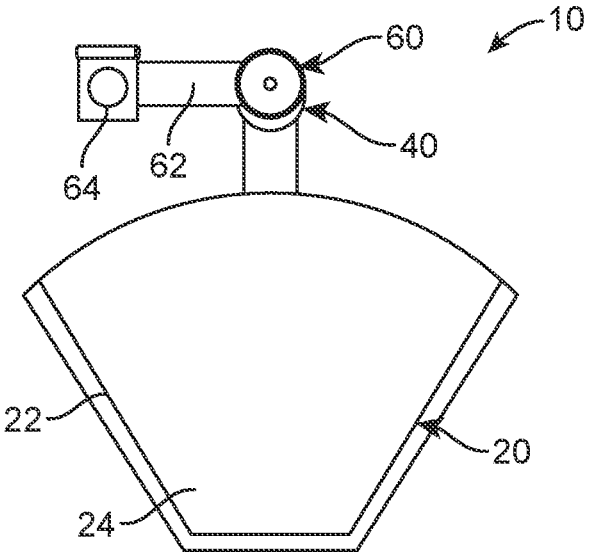
FIG. 4 is a representation of a top view of toilet seat lifting system 10 depicting the attachment member of latch assembly 60 in accordance to an embodiment of the present invention.

First plate 24 and second plate 26 includes four perimeter sides. In the present embodiment, a top perimeter side is provided as a circular perimeter extending across sides of the plates. The sides of the plate then taper inwardly to a bottom perimeter side of the plates. The bottom perimeter side of the plate is provided as a straight line. As observed in FIG. 4, the bottom perimeter sides of both first plate 24 and second plate 26 are then hingedly joined together at a predetermined angle. In on implementation that hinged angle is determined by a comfortable angle to receive the foot of a user. The hinged angle may be provided as any angle greater than 0 degrees and less than 45 degrees. An inflatable member 28 is then mounted between first plate 24 and second plate 26. In one embodiment, as observed in FIG. 3, inflatable member 28 is provided as a rigid inflatable member. Furthermore, inflatable member 28 is made of an elastic inflatable material such as rubber, plastic, and the like. First plate 24 receives a downward force which may be provided by a user's foot. This then causes the inflatable member to deflate and release air into the rod assembly 40.

Rod assembly 40 includes a bottom beam 42 and a top beam 44 which communicably assembled. In the present embodiment, as observed by FIG. 3, bottom beam 42 is hingedly mounted to bellows 22 through a hinged right-angle member. The hinged right-angle member is inserted to within the inflatable member 28. In the present embodiment, bottom beam 42 and the right-angle member are provided as hollow members which allow air to flow therein. As a result, bottom beam 42 is in air flow communication with bellows 22. The air that results from the deflation of the inflatable member 28 gets transferred to within the bottom beam 42.

Top beam 44 is also provided as a hollow beam member having a diameter greater than the diameter of bottom beam 42. In the present embodiment, as observed in FIG. 3, bottom beam 42 is inserted within the hollow portion of top beam 44. Bottom beam 42 then extends upwardly within top beam 44. Top beam 44 must be of a suitable larger diameter to provide a spacing between an outer wall of bottom beam 42 and top beam 44. The spacing provided must allow air to pass through the spacing. Top beam 44 includes a top end and a bottom end. The bottom end of top beam 44 includes an air tight seal 46 which secures top beam 44 to bottom beam 42 in an air tight configuration. In one embodiment, air tight seal 46 is provided as a rubber gasket ring which prevents any air from being escaped from within the spacing of the rod assembly 40. In the present embodiment, the air supplied by bellows 22 is transferred to bottom beam 42. The air travels through the bottom beam upwardly where it is then dispersed in the spacing between the bottom beam 42 and the top beam 44.

Latch assembly 60 is then mounted to the top end of top beam 44. Latch assembly 60 includes a latch member 62 which is hingedly mounted onto the top end of top beam 44. This configuration can clearly be observed in FIG. 2 of the drawings where latch 62 can be overserved entirely covering the top end of top beam 44. Latch 62 may be a plastic or metal member that is then mounted to a toilet seat of a toilet. Latch 62 includes an attachment member 64 mounted to a top end. In one implementation, attachment member 64 is provided as an adhesive material which adhesively receives the bottom end of the toilet seat. In another implementation, attachment member 64 is provided as a suction cup member which suctions to the bottom end of the toilet seat. This allows the toilet seat lifting system 10 to be easily removable and attachable to various toiletries. FIG. 1, effectively illustrates how attachment member 64 receives the bottom end of a toilet seat near the hinged connection of the toilet seat and the toilet. As previously described, the air from bellows 22 travels to the spacing of rod assembly 40. The air within the spacing of rod assembly 40 then becomes effectively trapped and air pressure is created within the spacing. The air pressure created is then forced to be released from the top end of top beam 44. The air pressure causes the hinged latch member 62 to move upwardly in order to allow the air to escape. The upward force of the latch member in turn then causes the toilet seat of the toilet to be lifted up. In the present embodiment, the toilet seat lifting system 10 effectively lifts the toilet seat between a sixty-five degree and eighty-degree range with respect to the toilet.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A toilet seat lifting system, consisting of:

a. a toilet mounted to a ground surface, said toilet including a toilet seat;

b. a bellows assembly including a bellows having a top plate and a bottom plate, wherein said bottom plate is mounted to said ground surface next to said toilet, wherein said top plate and said bottom plate each include a top perimeter edge, a bottom perimeter edge, and a side perimeter edges, wherein said top perimeter edge is a circular perimeter edge, wherein said bottom perimeter edge is a straight edge, wherein said perimeter side edges taper inwardly from said top perimeter edge to said bottom perimeter edge, wherein said top plate and said bottom plate are hingedly joined together on said bottom perimeter edge, wherein said bellows assembly further includes an inflatable member located between said top plate and said bottom plate, wherein said inflatable member is a rigid inflatable member, wherein said top plate is elevated at an angle between zero degrees and forty-five degrees with respect to said bottom plate;

c. a rod assembly including a bottom beam and a top beam, wherein said bottom beam is mounted to said bellows, a right angle hinged member coupling said bottom beam and said inflatable member of said bellows, wherein said bottom beam and said top beam are hollow rods, said top beam having a diameter greater than said bottom beam, said bottom beam inserted within said top beam and extending upwardly therein, a spacing between an outer sidewall of said bottom beam and inner sidewalls of said top beam, said top beam including an air tight seal at a bottom end, wherein said air tight seal is a rubber gasket, wherein said air tight seal secures said top beam to said bottom beam in an air tight configuration; and d. a latch assembly including a latch member hingedly mounted to a top end of said top beam, wherein said latch member is a rectangular latch having a hinged connection with said top beam, wherein said latch member entirely covers said top end of said top beam, said latch member including an attachment member mounted to a top end of said latch member, wherein said attachment member is a suction cup member, wherein said latch member is mounted to a bottom end of said toilet seat, wherein said bellows receives a downward force to supply air within said bottom beam, wherein said air is then released from said bottom beam into said spacing creating air pressure, said air pressure being released from said top end of said top beam to then push said latch member upwardly.

* * * * *